United States Patent [19]

Quella et al.

[11] 4,382,272

[45] May 3, 1983

[54] COLORED LAMP

[75] Inventors: Ferdinand Quella, Gauting; Heinz Pape, Munich, both of Fed. Rep. of Germany

[73] Assignee: Siemens Aktiengesellschaft, Berlin & Munich, Fed. Rep. of Germany

[21] Appl. No.: 201,555

[22] Filed: Oct. 28, 1980

[30] Foreign Application Priority Data

Nov. 15, 1979 [DE] Fed. Rep. of Germany ..... 2946191

[51] Int. Cl.[3] ..... F21V 9/16

[52] U.S. Cl. ..... 362/84; 362/32; 362/217; 362/223; 362/260; 362/318

[58] Field of Search ..... 362/32, 84, 217, 223, 362/260, 318; 350/345

[56] References Cited

U.S. PATENT DOCUMENTS

| | | | |
|---|---|---|---|
| 3,157,362 | 11/1964 | Waly | 362/84 |
| 3,265,877 | 8/1966 | Howell | 362/84 |
| 3,791,058 | 2/1974 | Mollica | 362/84 |
| 4,070,763 | 1/1978 | Carts | 362/32 |
| 4,142,781 | 3/1979 | Baur | 350/345 |

*Primary Examiner*—Donald P. Walsh

*Attorney, Agent, or Firm*—Hill, Van Santen, Steadman, Chiara & Simpson

[57] ABSTRACT

A colored lamp is emitting colored light of a given range of wavelengths and particularly useful for interior and exterior lighting, for luminous advertising, for street lighting, for signal lights and for decorations characterized by a source of light and an arrangement for absorbing a light wave spectrum which has a shorter wavelength than the given range and for emitting light with a longer wavelength due to photo-luminescence with the arrangements including at least one body provided with a luminescent substance for absorbing the light and emitting the luminescent light. The body may be formed by a container of liquid, a bundle of optical fibers or a solid member which acts as a light concentrator in such a manner that the incident light is collected and conducted by means of a photo-luminescent scattering and subsequent total reflection at the boundary surfaces of the body, with the luminescent light being emitted in specific output locations.

18 Claims, 3 Drawing Figures

COLORED LAMP

BACKGROUND OF THE INVENTION

The present invention is directed to a colored lamp for emitting colored light of a given range of wavelengths particularly used for both exterior and interior lighting, for luminous advertising, for street lighting, for signal lamps, and for decorations.

Colored lamps up until now have been produced by various means for example by utilizing a gas discharge tube with various fillings and luminous substance, or a second example by either the light source itself or the lamp housing surrounding the light being provided with a colored filter which is only permeable to one part of the light spectrum being emitted by the light source. In the first case or example, the color being emitted is determined by the emission lines of the filling gas and the inorganic luminous substances being used. In the second example, a large part of the light generated by the light source is absorbed and thus is lost.

Specially fabricated fluorescent tubes have often been employed for generating luminous, highly visible signs or other characters. However, such arrangements are structurally extravagant and therefore relatively expensive. A simpler solution is a back lighting of a dark plate with bright transparent characters or a transparent plate having dark characters which provide dark symbols on a bright background. In this method, a large part of the light generated for the background lighting is again lost to absorption.

SUMMARY OF THE INVENTION

The present invention is based on providing a colored lamp with the simplest possible structure which lamp exhibits a higher efficiency for generating colored light of a given spectrum with relatively high intensity over its surfaces shaped as desired. For example in the form of letter or characters.

To accomplish these objects, a colored lamp for emitting colored light of a given range of wavelengths comprises a source of light and means for absorbing a light wave spectrum which have a shorter wavelength than the given range and for emitting light with a longer wavelength due to photo-luminescence, said means including at least one body being provided with a luminescent substance for absorbing the light and emitting the luminescent light. It should be noted that the body may be part of the housing of the lamp or an additional housing part. The luminescent particles may be either fluorescent particles or phosphorescent particles which are worked into the material of the body or have been superficially applied to a surface of the body of example, as a luminescent reflector.

The luminescent substance may be an organic fluorescent dye, which is in a solid organic solution in a body of material such as polymethyl methacrylate. In general, however, the fluoroescent and/or phosphorescent particles can be organic or inorganic materials and may exist in the body or on a surface in either a solid solution or as undissolved pigments.

In the following, any part of a body, which is part of the lamp housing and in which the photo-luminescent particles have either been introduced or have been applied superficially, is called an luminescent body.

The solution according to the present invention offers three significant advantages:

1. In an absorbent dye lamp, which absorbs light from a light source such as a red lamp, the normal short-wave spectrum range with an approximate wavelength of $\lambda < 600$ nm is lost. However, in a lamp of the present invention having a body provided with fluorescent dyes, this short-wave spectrum range is absorbed and is not lost but rather in most part is re-emitted as a fluorescent light with a longer wavelength with the fluorescent yield normally being greater than or equal to 90%. The yield of colored light is therefore increased in comparison to the standard absorbent dyed lamp. In a practical case, this means that a colored lamp which was previously equipped with a light source with an output of for example 100 watt can be equipped with a light source of a lower output in order to produce the same radiation intensity throughout the housing. Thus, the savings in the energy depend among other things on the spectral energy distribution of the light source and on the absorption bands of the fluorescent dyes or particles.
2. The color of the light source can be changed by means of interchanging the body particularly if the body is in the form of a plate. An automatic color change device in front of a white light source can also be equipped with luminescent bodies. In traditional colored fluorescent tubes or lamps, a simple change of color is not possible.
3. In a significant further development of the invention, the luminescent body functions as a light concentrator. Give a suitable execution of the luminescent body which is formed of a super transparent material, for example PMMA, which is a polymethyl methacrylate, and the body can be suitably shaped with smooth surfaces, so that a very large part of the luminescent light, which is approximately 75% for the material PMMA, is held and conducted by means of total reflection at the boundary surfaces of the luminescent body. This light can only be emitted at those locations either at which the total reflection has been interrupted or at which no measures have been undertaken for returning the light back into the fluorescent body such as by means for reflecting. For example the narrow side edges of the plate which are usually provided with a diffusing reflector to return the light back into the plate. The output locations for example are the narrow sides or edges of the plate, notches, rough parts of a surface or part of the surface which has been printed with light scattering pigments, or provided with bubbles, and scattering centers which are provided in the material of the plate. Thus, the intensity of the light being emitted at the output location is higher by a factor which in a first approximation is proportional to the ratio of the light collecting surface to the area of the output locations.

Thus, given a suitable designed luminescent body, light can be collected in a wide surface area and be concentrated into output locations, and such a body is easy to manufacture in the desired shape. Apart from the very beautiful decorative effect, the lamp provided with the body which achieves by locally increases of the intensity, can be used as an illuminated sign whose characters can be easily realized with great luminous intensity because of the good light exploitation. As an example, assume a light source comprising a fluorescent tube being located behind a body which is a plate-shaped fluorescent body having output locations in the shape of letters. On the side of an observer, this plate is covered by a foil, layer or plate which is either opaque at least for the fluorescent light but has transparent interruptions in the area of each of the output locations. The fluorescent body and the covering plate or foil form a front side or surface of the lamp housing which is constructed to provide internal reflection of the light from the light source.

The invention provides a further development wherein the luminescent substance is worked into a transparent material of the luminescent body as undissolved pigments and the transparent material is selected to have index of refraction which coincides as well as possible with the index of refraction of the pigments. By so doing, scattering losses are kept small and it is possible to design a luminescent body as a light concentrator even when luminescent pigments are in the material of the body. A solution in the transparent carrier materials is often impossible or has a very deterious effect on the phosphorescence particularly when utilizing phosphorescent material. This undissolved pigment overcomes this problem.

According to a further development of the invention, a clear transparent material for conducting the luminescent light is provided. Light conduction in the dye material will be conducted with losses. A nearly loss free light conduction through the clear transparent material across specific areas for example such areas that are not reached by the excitation light from the light source is therefore an advantage in some special uses.

According to a further development of the invention, reflectors for guiding the luminescent light are provided. With the assistance of the reflectors, the luminescent light which leaves the luminescent body in locations which are not desired as output locations can be returned to the luminescent body. Examples of these locations are the narrow side edges of the plate. Moreover, since the mirrors or reflecting layers will enable light conduction around sharp corners, the number of possible spatial shapes for the light concentrator are increased.

According to a further development, reflectors or mirrors can be attached to those locations of a luminescent body which for structural reasons the light conduction by means of total reflection cannot be maintained. Examples would be areas at which the plate is mounted in the lamp structure. Thus, losses at the support mounts for example can be avoided or reduced.

According to a further development of the invention, the covering foil or layer may be permeable to the excitation light for the luminescent particles. Thus, light coming from the observers side can also be added to the light utilized for exciting and causing the photoluminescence.

According to a further development of the invention, a plurality of different luminescent substances are homogenously provided or worked into the luminescent body. This has the advantage that the light provided by a light source such as a fluorescent tube can be optimally shifted with auxiliary dyes into the absorption range of the luminescent substance. Thus the emission of the one luminescent substance will overlap with the absorption band of the second substance.

According to a further development of the invention, a spatially inhomogeneous distribution of one or more of the luminescent substances is provided in one or more of the luminescent bodies. By so doing, various decorative effects can be achieved.

In addition, a multitude of different methods of output coupling light from the luminescent body is provided. Each method has certain advantages which occur from their respective use.

Fluorescent tubes are preferably employed as the light source for the exciting of the photo-luminescence. This is due to the fact that fluorescent tube has a high light yield and a low heat build up.

According to a further development of the invention, a container with a luminescent fluid may be used as the body or the body can be formed by a fiber optical bundle in which each of the fibers of the bundles have a luminescent substance worked or provided on the fiber. In both instances, a very interesting decorative possibility can be achieved. One can perhaps think of air bubbles in an irradiated fluid in which a fluorescent dye or particles are dissolved or a PMMA fiber doped with different fluorescent substances. In the case of the bundle of optical fibers, if different fibers were treated with different fluorescent substances at their tips then different fiber ends would light up as the color or wavelength of the particular light being used for exciting the fluorescent substances was changed. For example, in combination with a light source, which is provided with a rotating color filter wheel, different colors could be obtained on different fibers which could not be obtained with an ordinary device within justifiable expenses.

DESCRIPTION OF THE PREFERRED EMBODIMENTS

Figure 1:
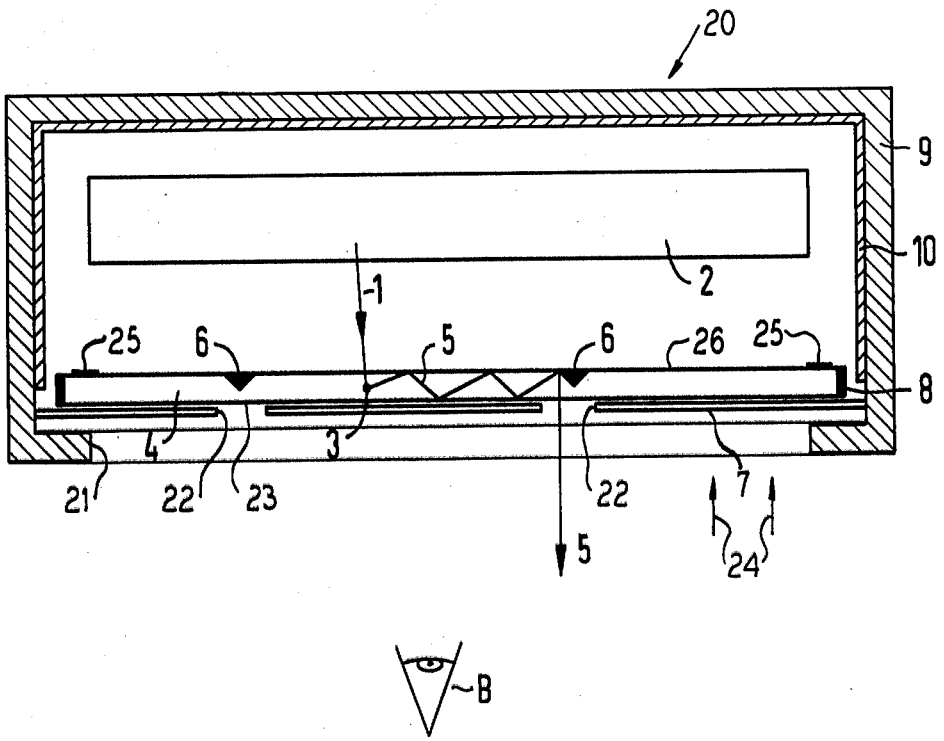
FIG. 1 is a diagrammatic cross-sectional side view with portions in elevation for purposes of illustration of an advertising illumination in accordance with the present invention.

The principles of the present invention are particularly useful in an illuminated advertising device generally indicated at 20 in FIG. 1. It is noted that the device 20 does not include parts such as electrical supply lines or supports, which are not necessary for understanding the present invention.

The device 20 has a box-shaped housing 9, which receives a light source such as a fluorescent tube 2 and supports a luminescent body 4 across an opening 21. The luminescent body 4 is designed as a light concentrator and has luminescent particles 3 such as fluorescent dye molecules which are worked into the material of the body 4. Thus, the fluorescent tube 2 produces the light rays 1 which strike the particles 3 of the luminescent body 4. Luminous light 5 is emitted from the particles 3 and is conducted by means of total reflection in the luminescent body 4 until it strikes an output location 6 and leaves the luminescent body 4 in the direction of the observer B. The output locations are illustrated as notches which are filled with a pigment which diffusedly reflects the luminescent light 5. By utilizing phosphorescent pigments whose absorption spectrum lies at a shorter wavelength than those of luminescent light 5 in the notches of the location 6, the output locations will still continue to glow a few hours after the fluorescent tube 2 has been switched off.

As illustrated, a cover plate or foil 7 which has apertures 22 corresponding to the output locations 6 is provided on a front surface 23 of the plate shaped body 4. By shaping the output locations 6 in the form of letters or characters which correspond to the shape of the apertures 22, the viewer will see a bright letter of character on a dark background due to the blocking of the emission of light by the foil or plate 7. While the plate is illustrated as having apertures 22, the plate could provide transparent areas at each of the locations for emitting the luminescent light 5. The cover plate 7 can either absorb the luminescent light in those areas not associated with the output locations 6 or can reflect the light back into the plate 4. In addition, while the plate 7 is either absorbing or reflecting the illuminescent light 5, it may be transparent to the wavelengths for exciting the luminescent substance 3 so that ambient light 24 entering the opening 21 of the housing passes through the plate 7 to excite the fluorescent pigments or particles 3.

While the luminescent light 5 will be entrapped in the plate 4 due to total reflection on the surfaces such as 23, it can escape through the narrow end or edge surfaces of the body. To prevent such an escape, these surfaces are provided with a reflective coating 8. A mounting structure of the housing 9 which engages portions of the surface 26 of the plate 4 may reduce the total reflection of the surface and thus the portions may be provided with a reflector or reflecting layer 25. In addition, to concentrate the emission from the fluorescent tube 2, the box shaped housing 9 is provided on the inside with its reflective layer 10 for example a coat of white paint.

Figure 2:
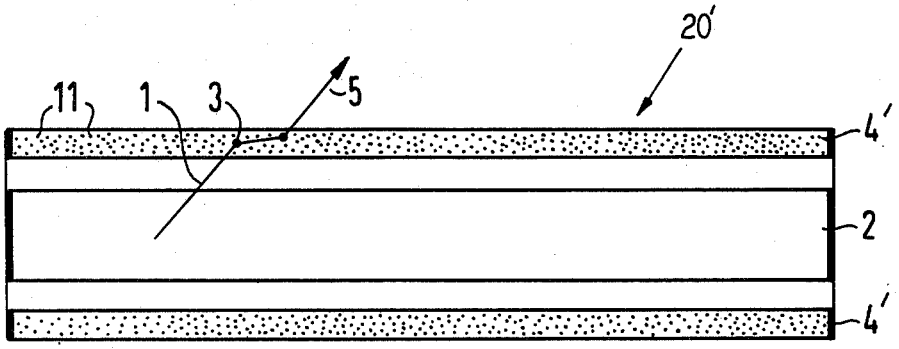
FIG. 2 is a cross-sectional view of a fluorescent tube with a luminescent housing in accordance with the present invention.

An embodiment of the invention is illustrated at 20′ in FIG. 2 and includes a tube-shaped luminescent body 4′, which telescopically receives a light source such as a fluorescent tube 2. The luminescent body 4′ is provided with scattering particles 11 in addition to the luminescent particles 3 and the scattering particles 11 help couple out the colored luminescent light from the body 4′.

Figure 3:
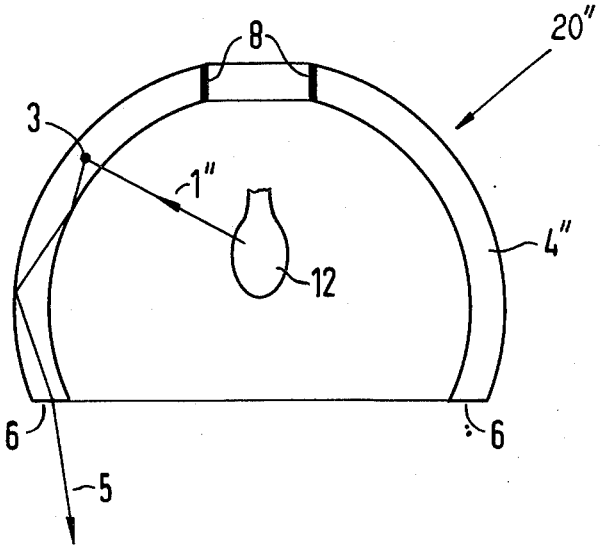
FIG. 3 is a diagrammatic cross-sectional view with the portions in elevation of an incandescent lamp with a luminescent housing in accordance with the present invention.

Another embodiment of the light is generally indicated at 20″ in FIG. 3. In the embodiment of the device 20″, the light source is an incandescent lamp 12 and the body 4″ is constructed as a light concentrator having a shape of a lamp shade and surrounds the lamp 12. As illustrated, the light waves 1″ from the incandescent light 12 are absorbed by the luminescent particles 3 to produce the luminescent light 5. The luminescent light 5 is allowed to escape through the outlet area 6, which is a circular edge of the shade forming the body 4″. The opposite circular edge of the body 4″ is provided with a reflective layer or means for reflecting such as a diffusedly reflecting layer 8.

Although various minor modifications may be suggested by those versed in the art, it should be understood that we wish to embody within the scope of the patent granted hereon, all such modifications as reasonably and properly come within the scope of our contribution to the art.

We claim:

1. A colored lamp for emitting colored light of a given range of wavelengths, said lamp comprising a housing having an opening, a source of light being disposed in said housing and providing light of a given light wavelength spectrum, and means for absorbing the light of said light wavelength spectrum which has a shorter wavelength than a given range and emitting light with a longer wavelength in the given range, said means being disposed across said opening and including at least one luminescent body of transparent material containing fluorescent particles for absorbing light of the light wavelength spectrum and emitting fluorescent light of said longer wavelength, said particles being disposed in said body, said body being a light concentrator having at least one output location for output coupling light being conducted therein so that said body collects incident light by absorbing it at said particles and by total reflection of the emitted fluorescent light at the boundary surfaces of the body until the emitted fluorescent light is output coupled at said output locations.

2. A colored lamp according to claim 1, wherein the luminescent body is composed of a transparent material having the fluorescent particles being undissolved pigments scattered therethrough, said transparent material and said pigments being selected so that the index of refraction of the transparent material coincides as well as possible with the index of refraction of the pigments.

3. A colored lamp according to claim 1, wherein reflective means are employed for guiding the fluorescent light being conducted in said body.

4. A colored lamp according to claim 1, which includes means for reflecting being provided at locations of said body at which locations total reflection of the light is not obtained due to structural features.

5. A colored lamp according to claim 1, wherein the luminescent body except at the output location is arranged with a layer on a front surface thereof, said layer reflecting the fluorescent light back into said body.

6. A colored lamp according to claim 5, wherein said layer being transparent to the excitation light for the fluorescent particles.

7. A colored lamp according to claim 1, wherein the luminescent body adjacent one surface except in the output location is provided with a foil which greatly absorbs the fluorescent light.

8. A colored lamp according to claim 7, wherein said foil is transparent to the excitation light for the fluorescent particles.

9. A colored lamp according to claim 1, wherein the output locations are formed by means for changing the optical characteristics of a surface of the body.

10. A colored lamp according to claim 9, wherein said means for changing the optical characteristics comprises printing pigments on said surface.

11. A colored lamp according to claim 9, wherein the means for changing optical characteristics include coated notches, bulges and bubbles provided in the surface of the body.

12. A colored lamp according to claim 1, wherein each of the output locations is formed by means disposed in said body for changing the optical transmission of light therein.

13. A colored lamp according to claim 12, wherein said means for changing the optical transmission includes additives with a greatly different index of refraction, scattering centers, and scattering particles deposited in the material of the body.

14. A colored lamp according to claim 1, wherein the plurality of different fluorescent particles are provided in the luminescent body.

15. A colored lamp according to claim 1, wherein different fluorescent particles are provided in said body with topically differing concentrations.

16. A colored lamp according to claim 1, which includes at least one additional luminescent body having a fluorescent particles associated therewith.

17. A colored lamp according to claim 1, wherein the source of light is a fluorescent tube.

18. A colored lamp according to claim 17, wherein the emission spectrum of the fluorescent tube and the absorption spectrum of the fluorescent particles are matched to one another.

* * * * *